US009609929B2

(12) United States Patent
Farrelly

(10) Patent No.: US 9,609,929 B2
(45) Date of Patent: Apr. 4, 2017

(54) LUGGAGE WITH SHELLS HAVING VARIED DEPTHS

(71) Applicant: Samsonite IP Holdings S.a.r.l., Luxembourg (LU)

(72) Inventor: Sean B. Farrelly, Somerset, MA (US)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 0 days.

(21) Appl. No.: 15/052,133

(22) Filed: Feb. 24, 2016

(65) Prior Publication Data

US 2016/0166025 A1 Jun. 16, 2016

Related U.S. Application Data

(63) Continuation of application No. 14/683,312, filed on Apr. 10, 2015, now Pat. No. 9,282,794, which is a (Continued)

(51) Int. Cl.
*A45C 5/03* (2006.01)
*A45C 5/14* (2006.01)
(Continued)

(52) U.S. Cl.
CPC ..... *A45C 5/03* (2013.01); *A45C 5/14* (2013.01); *A45C 13/103* (2013.01); *A45C 13/262* (2013.01); *A45C 2005/037* (2013.01)

(58) Field of Classification Search
CPC ... B62B 2205/04; B62B 3/001; B62B 5/0083; B62B 2202/04; B62B 2301/08
See application file for complete search history.

(56) References Cited

U.S. PATENT DOCUMENTS 2,754,870 A 7/1956 Glantz et al.
D360,756 S 8/1995 King
(Continued)

FOREIGN PATENT DOCUMENTS

CA 2785061 C 10/2013
CN 1274263 A 11/2000
(Continued)

OTHER PUBLICATIONS

Extended European Search Report dated Apr. 7, 2014, of corresponding European Patent Application No. 13191748.6, 5 pages.
(Continued)

*Primary Examiner* — John Walters
*Assistant Examiner* — James Triggs
(74) *Attorney, Agent, or Firm* — Dorsey & Whitney LLP

(57) ABSTRACT

A luggage case (100, 600, 700, 800, 900) may include opposing sidewalls forming minor faces (105, 106), opposing sidewalls forming major faces (101, 102), and opposing end walls (103, 104) together forming an article defining an enclosed space (109). A line of separation (150) may be formed in said minor faces (105, 160) and end walls (103, 104). A first portion of the line of separation (150) may extend along a first portion of opposing minor faces (105, 106) at a location proximate one of said opposing major faces (101, 102) and corresponding one of said opposing end walls (103, 104) positioned therebetween. A second portion of the line of separation (150) may extend along a second portion of said opposing minor faces (105, 106) in a direction away from said one of said opposing major faces (101, 102) and towards other of said opposing major faces (101, 102).

20 Claims, 8 Drawing Sheets

Related U.S. Application Data continuation of application No. 13/844,359, filed on Mar. 15, 2013, now Pat. No. 9,066,565.

(60) Provisional application No. 61/724,660, filed on Nov. 9, 2012.

(51) Int. Cl.
*A45C 13/10* (2006.01)
*A45C 13/26* (2006.01)

(56) References Cited

U.S. PATENT DOCUMENTS

| | | | |
|---|---|---|---|
| D375,199 | S | 11/1996 | Stokes et al. |
| D383,603 | S | 9/1997 | Pedlar |
| D383,905 | S | 9/1997 | Stokes et al. |
| 5,875,876 | A | 3/1999 | Wang |
| D425,301 | S | 5/2000 | Sagol |
| D435,967 | S | 1/2001 | Tiramani et al. |
| 6,367,603 | B1 | 4/2002 | Tiramani et al. |
| D462,169 | S | 9/2002 | Giovanni |
| 6,499,575 | B1 | 12/2002 | Tsai |
| D472,705 | S | 4/2003 | Van Himbeeck |
| 6,869,086 | B2 | 3/2005 | Sadow |
| D525,031 | S | 7/2006 | Miles et al. |
| 7,143,878 | B2 | 12/2006 | Selvi |
| D540,036 | S | 4/2007 | Newson |
| 7,296,665 | B2 | 11/2007 | Morszeck |
| 7,398,868 | B2 | 7/2008 | Morszeck |
| D587,902 | S | 3/2009 | Yoneno |
| 7,832,533 | B2 | 11/2010 | Selvi |
| D659,395 | S | 5/2012 | Sijmons |
| D664,355 | S | 7/2012 | Moon |
| D666,000 | S | 8/2012 | Gifford |
| D709,696 | S | 7/2014 | Wu |
| D710,610 | S | 8/2014 | Sijmons et al. |
| D711,646 | S | 8/2014 | Ke |
| D711,649 | S | 8/2014 | Chen |
| 9,060,577 | B2 | 6/2015 | Farrelly et al. |
| 9,066,565 | B2 | 6/2015 | Farrelly |
| D734,948 | S | 7/2015 | Farrelly |
| 9,282,794 | B2 | 3/2016 | Farrelly |
| 2004/0188205 | A1 | 9/2004 | Badaan |
| 2005/0056511 | A1 | 3/2005 | Hsieh |
| 2007/0209894 | A1 | 9/2007 | Selvi |
| 2008/0223678 | A1 | 9/2008 | Godshaw et al. |
| 2009/0145710 | A1* | 6/2009 | Roncato ..... A45C 13/04 190/103 |
| 2011/0097021 | A1 | 4/2011 | Curran et al. |
| 2011/0186396 | A1 | 8/2011 | Sheikh |
| 2011/0186398 | A1 | 8/2011 | Sheikh |
| 2012/0181129 | A1 | 7/2012 | Lai |
| 2014/0131155 | A1 | 5/2014 | Santy |
| 2014/0131156 | A1 | 5/2014 | Farrelly et al. |
| 2014/0131964 | A1 | 5/2014 | Farrelly |
| 2014/0166416 | A1 | 6/2014 | Krulik et al. |
| 2015/0320164 | A1 | 11/2015 | Farrelly |

FOREIGN PATENT DOCUMENTS

| | | | |
|---|---|---|---|
| CN | 2904733 | Y | 5/2007 |
| CN | 201175054 | Y | 1/2009 |
| CN | 202019925 | U | 11/2011 |
| CN | 301896739 | S | 5/2012 |
| DE | 3819617 | A1 | 12/1989 |
| DE | 19531362 | A1 | 2/1997 |
| DE | 20122181 | U1 | 7/2004 |
| EM | 000425285-0007 | | 10/2005 |
| EM | 000709019-0001 | | 4/2007 |
| EM | 001919721-0001 | | 9/2011 |
| EM | 002136127-0004 | | 11/2012 |
| EM | 002144337-0001 | | 11/2012 |
| EM | 002229815-0001 | | 4/2013 |
| EM | 002310292-0005 | | 10/2013 |
| FR | 1304831 | A | 9/1962 |
| GB | 2429636 | | 3/2007 |
| WO | 99/44807 | A1 | 9/1999 |
| WO | 0005990 | A1 | 2/2000 |
| WO | 01/54534 | A2 | 8/2001 |
| WO | 2007/014804 | A1 | 2/2007 |
| WO | 2011/093984 | A1 | 8/2011 |
| WO | 2012056009 | A2 | 5/2012 |
| WO | 2013/126654 | A1 | 8/2013 |
| WO | 2014/100308 | A1 | 6/2014 |

OTHER PUBLICATIONS

Suitcases Landor & Hawa (IT Luggage TM)—the lowest prices in Moscow obtained at URL: http://sumki-chemodani.ru/?page_id=103, on Jul. 2, 2013, the product entitled Suitcase Landor & Hawa (it luggage TM) 00230253 spinner. Russian version of web-page and English translation as provided in attachment, 8 pages.

* cited by examiner

LUGGAGE WITH SHELLS HAVING VARIED DEPTHS

CROSS REFERENCE TO RELATED APPLICATIONS

This application is a continuation of co-pending U.S. patent application Ser. No. 14/683,312 entitled "Luggage with Shells Having Varied Depths filed on Apr. 10, 2015, which is a continuation of U.S. patent application Ser. No. 13/844,359 entitled "Luggage With Shells Having Varied Depths" filed on Mar. 15, 2013, which claims the benefit under 35 U.S.C. §119(e) to U.S. Provisional Patent Application No. 61/724,660, entitled "Luggage With Shells Having Varied Depths" and filed on Nov. 9, 2012, which are hereby incorporated in their entireties by reference as though fully disclosed herein.

TECHNICAL FIELD

The technical field generally relates to hard side luggage cases.

BACKGROUND

Many hard side luggage cases include four spinner wheels coupled to the bottom of the luggage case so that the luggage case can be moved laterally in any direction without the need to tip the luggage case onto a pair of wheels for transport. The spinner wheels also facilitate "spinning" the luggage case around a 360° rotation. The coupling of the spinner wheels to the bottom of the luggage case, however, typically requires a relatively large surface area on the bottom of the luggage case in order to provide stability for attachment of the spinner wheels, and/or for the luggage case itself. Accordingly, most hard side spinner luggage cases have a bottom that is divided into a front half and a rear half that are approximately the same size. This configuration is intended to provide sufficient surface area for two spinner wheels to be coupled to the front half of the bottom of the luggage case and two spinner wheels to be coupled to the rear half of the bottom of the luggage case. The division of the bottom of the luggage case into approximately equal front and bottom halves typically extends through the entire body of the luggage case, thus creating a hard side luggage case with a "lid" formed of the front half and a "base" formed of the rear half, each having an approximately equal volume.

Such an arrangement, however, can make packing the luggage case relatively awkward, as approximately half of the volume corresponding with the lid, (and therefore approximately half of the weight of the packed luggage case) must be pivoted relative to the base each time the luggage case is opened or closed. A zippered fabric retainer or liner may help prevent articles from falling out of the packed lid of the luggage case, but the weight of the packed lid may nonetheless be inconvenient for users to lift when opening or closing the packed luggage case.

It is with these shortcomings in mind that the object of the present disclosure was developed.

Documents that may be related to the present disclosure in that they include various approaches to luggage case construction include: EP 1,638,427, US 2004/0188205, U.S. Pat. No. 6,499,575, US 2008/0223678, OHIM 000709019-0001, OHIM 000425285-0007, CN 2904733Y, and CN 201175054Y. Additionally, the following commercially available luggage case may be related: Samsonite Pixelcube.

SUMMARY

Described herein are hard side luggage cases.

In one example, a luggage case may include opposing sidewalls forming minor faces, opposing sidewalls forming major faces, and opposing end walls together forming an article defining an enclosed space. A line of separation may be formed in the minor faces and end walls along which the article separates. A first portion of the line of separation may extend along a first portion of opposing minor faces at a location proximate one of the opposing major faces. The line of separation may also extend along corresponding one of the opposing end walls positioned therebetween. A second portion of the line of separation may extend along a second portion of the opposing minor faces in a direction away from the one of the opposing major faces and towards the other of the opposing major faces. The first portion of the line of separation and the second portion of the line of separation may extend in two different directions. At least one support element may be operably associated with the other of the opposing end walls.

The second portion of the line of separation may extend around at least a portion of the at least one support element to position the at least one support element toward the one of the opposing major faces relative to the second portion of the line of separation.

The second portion of the line of separation may extend around at least a portion of the at least one support element to position the at least one support element toward the other of the opposing faces.

The second portion of the line of separation may extend across the other of the end walls. At least two support elements may be mounted on the other of the end walls. The second portion of the line of separation may pass between the at least two support elements.

The at least two support elements may be mounted on either side of the line of separation.

At least two of the support elements may be wheels.

The at least two wheels may be spinner wheels.

The at least two spinner wheels may be on the same side of the line of closure.

The at least two spinner wheels may be each positioned on the other of the end walls adjacent a corner defined by the intersection of an adjacent minor face, major face and the other of the end walls.

The line of separation may extend across the other of the end walls at a location generally between the opposing major faces and not adjacent either of the opposing major faces.

At least two of the support elements may be foot support elements.

Each of the at least two foot support elements may be mounted on opposite sides of the line of separation.

The first portion of the line of separation may extend along a substantial height of the case. The second portion may define a deeper depth of the lid than defined by the first portion.

The first portion may extend along greater than 80 percent of the height of the case.

The one of the opposing end walls may define a top face of the luggage case. The other of the opposing end walls may define a bottom face of the luggage case.

The line of separation along the first portion may be substantially parallel to the one of the opposing major faces.

The line of separation along the first portion may be substantially parallel to the other of the opposing major faces.

No part of the lid along the first portion of the line of separation may be deeper than along the second portion.

A transition region between the first and second portions may define a distinct transition.

The transition may be one of either a discrete angle or a curve.

The second portion of the line of separation may extend across the second portion of the minor faces and across the other of the opposing major faces.

The second portion of the line of separation may extend across the second portion of the minor faces and across the other of the opposing end walls.

The second portion of the line of separation may intersect a common edge between the minor faces and other of the opposing end walls at an angle to the other of the opposing end walls.

The second portion of the line of separation may intersect a common edge between the minor faces and the other of the opposing end walls perpendicular to other of the opposing end walls.

The support element may include at least two spinner wheels operably associated with the other of the opposing end walls.

In another example, a luggage case may include a lid operatively coupled to a base. The lid and the base may define a line of closure along abutting edges of respective perimeters of the lid and the base. The line of closure may define a first depth of the lid and a first depth of the base along an upper portion of the case. The line of closure may further define a second depth of the lid and a second depth of the base along a lower portion of the case. The first depth of the lid may be shallower than the first depth of the base. The second depth of the lid may be larger than the first depth of the lid. A plurality of wheels may be coupled to the lower portion of the base.

The luggage case may include a top half and a bottom half. The lower portion of the luggage case may not include any part of the top half of the luggage case.

At least a portion of the plurality of wheels may be spinner wheels.

The line of closure may further define a third depth of the lid and a third depth of the base along a third portion of the case. The line of closure may intersect a bottom face of the case perpendicular to the bottom face.

The plurality of wheels may include a first plurality of spinner wheels. The luggage case may include front, rear, top, bottom, left, and right faces. The first plurality of spinner wheels may be coupled to the bottom face. The line of closure may jog around the first plurality of spinner wheels coupled to the lid along the respective left and right faces of the luggage case.

The line of closure may extend across the bottom face equidistant between the opposing front and rear faces. Each of the plurality of spinner wheels may be mounted at a respective corner defined by an intersection of the bottom face and either adjacent left or right side faces and the front face or either adjacent left or right side faces and the rear face.

The plurality of wheels may include a first plurality of spinner wheels. The luggage case may include front, rear, top, bottom, left, and right faces. The first plurality of spinner wheels may be coupled to the bottom face. The line of closure may jog around the first plurality of spinner wheels coupled to the lid along the bottom face of the luggage case.

In still another example, a luggage case may include opposing sidewalls forming minor faces, opposing sidewalls forming major faces, and opposing end walls together forming an article defining an enclosed space. A line of separation may be formed in the minor faces and end walls along which the article separates. A first portion of the line of separation may extend along a first portion of opposing minor faces at a location proximate one of the opposing major faces. The line of separation may also extend along corresponding one of the opposing end walls positioned therebetween. A second portion of the line of separation may extend along a second portion of the opposing minor faces in a direction away from the one of the opposing major faces and towards the other of the opposing major faces. The first portion of the line of separation and the second portion of the line of separation may extend in two different directions. A handle may be operably associated with the one of the opposing end walls. The handle may be positioned on the one of the opposing end walls at a location through which a longitudinal axis of the luggage case passes.

The one of said opposing end walls may define a top face of the luggage case. The other of the opposing end walls may define a bottom face of the luggage case.

In still another example, the luggage case may include opposing sidewalls forming minor faces, opposing sidewalls forming major faces, and opposing end walls together forming an article defining an enclosed space. A line of separation may be formed in the minor faces and end walls along which the article separates. A first portion of the line of separation may extend in a first direction along a first portion of opposing minor faces at a location proximate one of the opposing major faces. The line of separation may also extend along corresponding one of the opposing end walls positioned therebetween. A second portion of the line of separation may extend along a second portion of the opposing minor faces in a second direction away from the one of the opposing major faces and towards the other of the opposing major faces. A third portion of the line of separation may extend along a third portion of the opposing minor faces in a third direction away from the second direction. At least one support element may be operably associated with the other of the opposing end walls and positioned adjacent the third portion of the line of separation.

The third portion of the line of separation defines 0 to 30 percent of a total height dimension of the luggage case.

The one of said opposing end walls may define a top face of the luggage case. The other of the opposing end walls may define a bottom face of the luggage case.

The present disclosure advantageously provides hard side luggage cases that can be easier to pack, and less awkward to pivotally open or close than conventional hard side luggage cases. The lid may include less enclosed volume than the base (or vice versa) along at least a portion of the height of the luggage case. In some configurations, the enclosed volume of the lid is relatively less near a top portion of the luggage case and relatively increases near a bottom portion of the case.

In one example, a luggage case includes opposing sidewalls forming minor faces, opposing sidewalls forming major faces, and opposing end walls, all together forming an article defining an enclosed space. A line of separation is formed in the minor faces and end walls along which the article separates. A first portion of the line of separation extends along a first portion of opposing minor faces at a location proximate one of the opposing major faces, and also extends along corresponding one of the opposing end walls positioned therebetween. A second portion of the line of separation extends along a second portion of the opposing minor faces in a direction away from the one of the opposing major faces and towards the other of the opposing major faces. At least one support element is operably associated with the other of the opposing end walls. The first portion of the line of separation and the second portion of the line of separation may extend in two different directions.

The second portion of the line of separation may extend around at least a portion of the support element to position the at least one support element toward the one of the opposing major faces relative to the second portion of the line of separation. The first portion of the line of separation may extend along a substantial height of the case and the second portion may define a deeper depth of the lid than defined by the first portion. The first portion may extend along the majority of a height of the case, and in some examples may extend along substantially greater than 80 percent of the height of the case. The line of separation along the first portion may be substantially parallel to the other of the opposing major faces. No part of the lid along the first portion of the line of separation may be deeper than along the second portion. A transition region between the first and second portions may define a distinct transition, and the transition may be one of either a discrete angle or a curve. The second portion of the line of separation may extend across the second portion of the minor faces and across the other of the opposing major faces in some examples. The second portion of the line of separation may extend across the second portion of the minor faces and across the other of the opposing end walls in other examples. The second portion of the line of separation may intersect a common edge between the minor faces and other of the opposing end walls at an angle to the other of the opposing end walls and/or the second portion of the line of separation may intersect a common edge between the minor faces and the other of the opposing end walls perpendicular to other of the opposing end walls. The support element may include at least two spinner wheels operably associated with the other of the opposing end walls. In some examples, the line of separation may include a closing mechanism (which may be a zipper) and/or a hinge. A telescoping handle may be coupled to the one of the opposing major faces in some examples.

In another example, a luggage case includes a lid operatively coupled to a base, the lid and the base defining a line of closure along abutting edges of respective perimeters of the lid and the base. The line of closure defines a first depth of the lid and a first depth of the base along an upper portion of the case, and the line of closure further defines a second depth of the lid and a second depth of the base along a lower portion of the case. The first depth of the lid is shallower than the first depth of the base, the second depth of the lid is larger than the first depth of the lid, and a plurality of wheels is coupled to the lower portion of the base.

The line of closure may further define a third depth of the lid and a third depth of the base along a third portion of the case and the line of closure intersects a bottom face of the case perpendicular to the bottom face. The plurality of wheels may be a first plurality of spinner wheels and the line of closure may jog around at least one of the first plurality of spinner wheels, and the luggage case may include front, rear, top, bottom, left, and right faces, the first plurality of spinner wheels being coupled to the bottom face, and the line of closure jogging around the first plurality of spinner wheels coupled to the lid along the respective left and right faces of the luggage case. In some examples, the luggage case may include front, rear, top, bottom, left, and right faces, the first plurality of spinner wheels may be coupled to the bottom face, and the line of closure may jog around the first plurality of spinner wheels coupled to the lid along the bottom face of the luggage case.

The line of closure may include a hinge that operatively couples the lid to the base, with the hinge extending along a left face of the luggage case. The line of closure may advantageously extend substantially linearly along a top face of the luggage case proximate a top front edge of the luggage case. The line of closure may further extend substantially linearly from a top right edge of the luggage case along a right face of the luggage case for a first distance and then jog rearwardly to a location spaced from a right, front, bottom corner. The line of closure may also extend linearly from a top left edge of the luggage case along a left face of the luggage case for a second distance and then jog rearwardly to a location spaced from a left, front, bottom corner. The first and second distances may be approximately the same, and/or the first distance may be approximately 90% of a height of the luggage case. Furthermore, the line of closure may extend linearly along a bottom face of the luggage case at a midpoint between a front bottom edge and a rear bottom edge of the luggage case. In some examples, the line of closure may advantageously jog equidistantly around a surface of at least one spinner wheel.

In another example, a hard side luggage case includes a plurality of faces defining an enclosed volume and an external structure, the external structure being divided into a lid and a base, and the external structure having at least an upper portion and a transition portion along a height of the luggage case. A depth of the base in the transition portion tapers from a depth of the base in the upper portion to a depth of the base at one of the plurality of faces of the luggage case, and a depth of the lid in the transition portion tapers from a depth of the base at the one face of the luggage case to a depth of the lid in the upper portion.

The external structure may further include a lower portion along a height of the luggage case, and respective depths of the lid and the base in the lower portion may be substantially constant and similar to respective depths of the lid and the base at the bottom face of the luggage case. The ratio of the depth of the base in the upper portion to the depth of the lid in the upper portion may be approximately 80/20.

In still another example, a hard side luggage case includes a lid and a base selectively coupled together by a closure device. A plurality of spinner wheels are coupled to the luggage case. A depth of the base tapers towards a face of the luggage case, and a depth of the lid tapers away from the face of the luggage case.

In some instances, the closure device includes a zipper, and the zipper is coupled to the lid and the base along the tapering of the base and the lid. The zipper may advantageously jog around one of the plurality of spinner wheels. Furthermore, a volume of enclosed space corresponding to the lid may be substantially less than a volume of enclosed space corresponding to the base. In some instances, the face of the luggage case is a bottom face of the luggage case, and a ratio of the depth of the base at the bottom face of the luggage case to the depth of the lid at the bottom face of the luggage case is approximately 60/40. The ratio of the depth of the base in an upper portion of the luggage case to the depth of the lid in the upper portion of the luggage case may be approximately 80/20. In other instances, the face of the luggage case is a top face, the depth of the lid is zero at a bottom face of the luggage case, and each of the plurality of spinner wheels is coupled to the base on the bottom face of the luggage case.

This summary of the disclosure is given to aid understanding, and one of skill in the art will understand that each of the various aspects and features of the disclosure may advantageously be used separately in some instances, or in combination with other aspects and features of the disclosure in other instances.

DETAILED DESCRIPTION

Described herein is a hard side luggage case that is relatively easy to pack. The luggage case may include a lid and a base, and the interior volume of the lid may advantageously be substantially less than the interior volume of the base in some examples. This relative difference in volume facilitates top loading of the luggage case during packing, and allows the lid to be opened or closed relatively easily during use of the luggage case. At the same time, the example configurations also providing sufficient structural support for the spinner wheels. The uneven distribution of enclosed volume in the base as compared with the lid helps remedy the difficulties encountered when packing a conventional hard side luggage case that is evenly divided along the height of the luggage case into a lid and a base.

Figure 1:
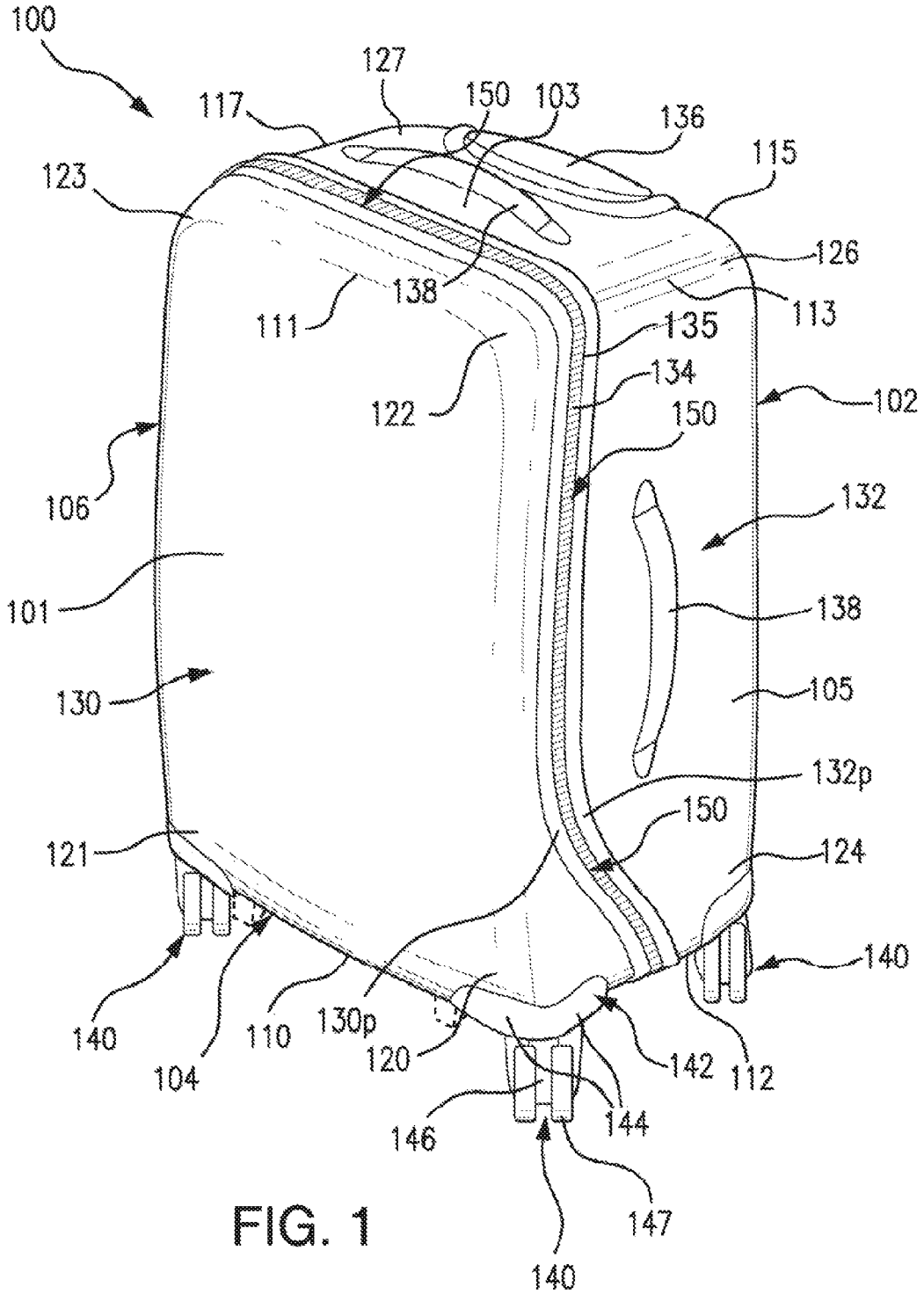
FIG. 1 is a front perspective view of a hard side luggage case having a line of closure curving away from a front major face at a lower portion of the luggage case.

With reference to FIG. 1, a hard side luggage case 100 may include a front major face 101 or sidewall, a rear major face 102 or sidewall, a top face 103 or end wall, a bottom face 104 or end wall, a right minor face 105 or side wall, and a left minor face 106 or sidewall that together define a housing or an outer structure that in turn defines an enclosed volume 109. As mentioned above, these portions of the luggage case may define a lid 130 and a base 132.

The outer structure of the luggage case 100 may be, for example, plastic (e.g., composite plastic, acrylonitrile butadiene styrene, polymer, thermoplastic, and so forth) and may be manufactured by extrusion, mold forming, blow molding, and so forth. The front face 101 and portions of the top, bottom, right, left, and front faces 103, 104, 105, 106 of the luggage case 100 may define at least a portion of the lid 130. The rear face 102 and portions of the top, bottom, right, and left faces 103, 104, 105, 106 of the luggage case 100 may define at least a portion of the base 132.

The luggage case 100 may further include at least one zipper 134 or other closure device. The zipper 134 or other closure device may secure the lid 130 to the base 132 along respective perimeters 130*p*, 132*p* of the lid 130 and the base 132 and may selectively allow access to at least one main compartment of the enclosed volume 109 when the closure device 135 is opened. The luggage case 100 may also include other features such as a telescoping handle 136 for a user to tow the luggage case 100, four spinner wheels 140 upon which the luggage case 100 may be rolled (which may be positioned on the bottom face 104 of the luggage case 100), one or more outer or inner pockets, an insert or tag for identification, and so forth. The luggage case may also include one or more fixed carry handle(s) 138 to facilitate carrying or lifting the luggage case. The fixed handles 138 may be positioned on the left 106 or right face 105, the top face 103, and/or the bottom face 104 of the luggage case 100.

The lid 130 and the base 132 may be joined together by a hinge 133 that allows the lid 130 to be selectively pivoted relative to the base 132 while remaining joined via the hinge 133. For example, the lid 130 of the luggage case 100 may be pivoted such that some of the abutting edges along the respective perimeters 130*p*, 132*p* of the lid 130 and the base 132 are separated, and such pivoting may allow a user to access the enclosed volume 109 of the luggage case 100. The hinge 133 may be formed of a zipper and fabric strip, a piano hinge, spaced-apart discrete hinges, an articulating joint of metal, plastic or other suitable material. The hinge 133 may be stitched to the lid 130 and also to the base 132, or may be coupled in another suitable manner. In some examples, the luggage case 100 may be hinged along the left 106 or the right 105 face, whereas in other examples, the luggage case 100 may be hinged along the bottom face 104, or along any other face of the luggage case 100.

The enclosed volume 109 of the luggage case 100 may be divided into one or more main compartments. In some luggage cases, the enclosed volume 109 may be divided by one or more panels, dividers, zippers, and so forth. For example, a zippered fabric liner (not shown in FIGS. 1 through 8) may separate the lid 130 volume of the luggage case 100 from the base 132 volume in order to facilitate opening and closing of the lid 130 when packed with articles of clothing. Alternatively, the enclosed volume 109 of the luggage case 100 may be a single main compartment. In still other cases, the enclosed volume 109 may be divided into a plurality of main or other compartments. For convenience, the luggage case 100 shown in FIG. 1 will be described herein as having a single, undivided main compartment with a lid 130 volume and a base 132 volume, although it will be understood that the enclosed volume 109 may include one or more main compartments, one or more sub-compartments, and so forth.

To aid in the description of the luggage case of the present disclosure, the following aspects of the luggage case are defined for future reference. A front bottom edge 110 may be defined by the transition between the front face 101 and the bottom face 104. A front top edge 111 may be defined by the transition between the front face 101 and the top face 103. A right bottom edge 112 may be defined by the transition between the right face 105 and the bottom face 104. A right top edge 113 may be defined by the transition between the right face 105 and the top face 103. A rear bottom edge 114 may be defined by the transition between the rear face 102 and the bottom face 104. A rear top edge 115 may be defined by the transition between the rear face 102 and the top face 103. A left bottom edge 116 may be defined by the transition between the left face 106 and the bottom face 104. A left top edge 117 may be defined by the transition between the left face 106 and the top face 103.

Furthermore, a right, front, bottom corner 120 may be defined by the intersection of the right, front, and bottom faces 105, 101, 104. A left, front, bottom corner 121 may be defined by the intersection of the left, front, and bottom faces 106, 101, 104. A right, front, top corner 122 may be defined by the intersection of the right, front, and top faces 105, 101, 103. A left, front, top corner 123 may be defined by the intersection of the left, front, and top faces 106, 101, 103. A right, rear, bottom corner 124 may be defined by the intersection of the right, rear, and bottom faces 105, 102, 104. A left, rear, bottom corner 125 may be defined by the intersection of the left, rear, and bottom faces 106, 102, 104. A right, rear, top corner 126 may be defined by the intersection of the right, rear, and top faces 105, 102, 103. A left, rear, top corner 127 may be defined by the intersection of the left, rear, and top faces 106, 102, 103.

Referring to FIGS. 1 through 4, the luggage case 100 may further include one or more support elements, such as spinner wheels 140 coupled to the luggage case 100. For example, four spinner wheels 140 may be coupled to the bottom face 104 of the luggage case 100, with two spinner wheels 140 coupled to opposing corners of the lid 130 (in the front, bottom corners 120, 121 of the luggage case 100) and two spinner wheels 140 coupled to opposing corners of the base 132 (in the rear, bottom corners 124, 125 of the luggage case 100). The spinner wheels 140 may alternatively be attached at locations not at the corners, and instead spaced inwardly from the outer periphery of the luggage case 100. In some cases, only three spinner wheels 140 may be used, with for example, one front spinner wheel 140 and two rear spinner wheels 140. In still other cases, an upright configuration may include only two wheels (which may be spinner-wheels or may be fixed-axle type wheels) and one or two front foot support elements (shown in dashed lines in FIGS. 1 and 4). In embodiments with one or more spinner wheels 140, each spinner wheel 140 may include a housing 142, and a swivel caster 146 including one or more wheels 147 each.

Referring still to FIGS. 1 through 4, when the spinner wheels 140 are attached proximate the bottom corners 120, 121, 124, 125 of the luggage case 100, the housing 142 of each spinner wheel 140 may include a base portion 143 and in some cases may include one or more side portions 144 that extend at approximately right angles from the base portion 143. The base portion 143 may be coupled to the bottom face 104 of the luggage case 100 at a corner in some examples, and the one or more side portions 144 may be coupled to the left, right, front, or rear faces 106, 105, 101, 102 of the luggage case 100 that form a respective corner. The base portion 143 of the housing 142 may be relatively flat, or the base portion 143 may include a domed recess 145 configured to receive at least a portion of the swivel caster 146 in order to form a lower profile and reduce the amount the spinner wheels 140 extend beyond the bottom face 104 of the luggage case 100. The one or more side portions 144 may generally conform to the shape of a portion of the left, right, front, or rear faces 106, 105, 101, 102 of the luggage case 100 to form a relatively smooth outer surface. The one or more side portions 144 may structurally reinforce the left, right, front, and/or rear faces 106, 105, 101, 102 of the luggage case 100, and/or may structurally reinforce its associated housing 142. The base portion 143 and/or the side portions 144 may be coupled to the luggage case 100 by one or more fasteners (not shown), such as screws, nails, bolts, adhesive, and so forth. For example, each spinner wheel 140 may each be secured to the bottom of the luggage case 100 by fasteners (not shown) through the bottom face 104 of the luggage case 100.

One swivel caster 146 may be coupled to the base portion 143 of each housing 142 by a fastener (not shown), such as a bolt or another type of fasteners that allow the swivel caster 146 to pivot relative to or within to the housing 142. The swivel caster 146 may include a forked body with a wheel 147 or wheels 147 coupled between the prongs of the forked body. Alternatively, the swivel caster 146 may include a tapered body with one wheel 147 coupled to each side of the tapered body.

The luggage case 100 may further include one or more closure device(s), 134 for example zippers 134, that provide access to the enclosed volume 109. In FIG. 1, a zipper 134 may be positioned along at least some of the edges of the perimeters 130*p*, 132*p* which abut when the lid 130 and base 132 are closed together. The zipper 134 may include a zipper tape that is coupled to the edges of the lid 130 and/or the base 132 (e.g., by stitching, beading, or other suitable coupling elements), one or more sliders, and one or more pull tabs joined to the one or more sliders. Alternatively or in addition to one or more zippers 134, the luggage case may include a different type of closure device 135 to selectively secure the lid 130 and the base 132 together and to selectively provide access to the enclosed volume 109 of the luggage case 100. For example, one or more clamps, ties, snaps, pin and hooks, and so forth may be provided. In the example shown in FIG. 1, a hinge 133 is positioned along at least a portion of the left face 106 of the luggage case 100 (not shown in FIG. 1) so that the luggage case 100 opens from right to left in FIG. 1 when unzipped.

With reference to FIGS. 1 through 4, when the luggage case 100 is closed, the respective perimeters and edges 130*p*, 132*p* of the lid 130 and the base 132 may abut along a line of closure or separation 150 of the luggage case 100. Generally, the closure device 135, such as a zipper 134, may be positioned along at least a portion of the line of closure 150. In some embodiments, the hinge 133 may also form a part of the line of closure 150. As described in more detail below, the line of closure 150 may advantageously jog around one or more spinner wheels 140 or other obstructions in order to provide sufficient structure to support the spinner wheels 140 and, simultaneously, unevenly distribute the enclosed volume of the lid 130 and the base 132 for more convenient packing of the luggage case 100.

Still with reference to FIGS. 1 through 4, the line of closure 150 may extend linearly along the top face 103 of the luggage case 100, and such line of closure 150 on the top face 103 of the luggage case 100 may be proximate the top front edge 111 (e.g., may be closer to the top front edge 111 than to the top rear edge 115). The line of closure 150 may extend linearly from the top right edge 113 of the luggage case 100 along the right face 105 for a distance (which may include the hinge 133) and then may jog rearwardly to a location spaced from the right, front, bottom corner 120 and in any event beyond the location of the spinner wheel 140 at the right, front, bottom corner 120. Similarly, the line of closure 150 may extend linearly from the top left edge 117 of the luggage case 100 along the left face 106 for a distance (which may include the hinge 133) and then may jog rearwardly to a location spaced apart from the left, front, bottom corner 121 and in any event beyond the location of the spinner wheel 140 at the left, front, bottom, corner 121. The line of closure 150 as depicted in FIG. 1-5, define an enlarged area of shell material around the spinner wheel 140 on the bottom and respective side faces sufficient for secure attachment of the spinner wheel to the case as described above. The line of closure 150 may also extend linearly along the bottom face 104 at a location spaced away from both the front bottom 110 and rear bottom 114 edges, and generally at a midpoint between the front and rear bottom edges 110, 114. In some examples, rather than extending linearly, the line of closure 150 may include one or more curves, angles, or other non-linear portions (in addition to the jogs described above), depending on the intended abutment structure and aesthetic look of the luggage case 100. As just one example, the line of closure may in some cases undulate along the top or bottom faces 103, 104 of the luggage case 100.

Referring to the line of closure 150 along the left and right faces 106, 105 of the luggage case 100, the jogging of the line of closure 150 may begin at one of many different points along the left and right faces 106, 105, and may generally be similar for both the left and the right faces 106, 105, though in other cases the line of closure 150 may be asymmetrical from side to side, and begin to jog at a certain height on the left side 106 that is different from the height on the right side 105 where the line of closure 150 begins to jog. In general, the line of closure 150 may begin to jog at a height of approximately 5 to 25% up from the bottom face 104 of the luggage case—for example, may begin to jog at a height of 10% up from the bottom face 104—on one or both of the left and right faces 106, 105 of the luggage case 100. In some embodiments, the line of closure 150 may be equidistant from a surface of a proximate spinner wheel 140.

With reference to FIGS. 1 through 4, the line of closure 150 (and the zipper 134 or other closure device 135) may be jogged just around the front two spinner wheels 140 on the left and right faces 106, 105 of the luggage case 100 in order to provide a greater depth of the base 132 along a substantial portion of the height h of the luggage case 100, as compared with a traditional hard side luggage case that is split approximately 50 percent—50 percent between the lid and the base along the entire height of the luggage case. In this manner, at least a portion of the line of closure 150 may be moved towards the front face 101 of the luggage case 100 to provide a shallower lid 130 as compared with traditional hard side luggage cases while avoiding obstructions usually found at the front of the bottom face 104 of the luggage case 100 (e.g., wheel housing, feet, handles, etc.). The jog may result in a greater depth of the lid 130 where helpful to support the spinner wheels 140 with sufficient structure, and also allows a shallow lid for relatively easy opening of the lid 130 during packing. In other embodiments, however, the line of closure may jog forwardly, rather than rearwardly, thus providing a relatively shallow base and a relatively deep lid.

As described earlier, foot support elements, instead of wheels, may be coupled to the bottom face 104 of the luggage case for an upright luggage configuration. For a luggage with an upright configuration, the line of closure 150 may not need to be jogged around the foot support element since the shallower lid 130 may still provide sufficient structural support. However, spinner wheels 140 may require improved structural support from the bottom of the lid 130 and the base 132 as compared to feet support elements. Accordingly, as shown in FIGS. 1-5, jogging the line of closure 150 on the left and right faces 106, 105 around the spinner wheels 140 creates a greater amount of shell material surrounding the mounting location of the spinner wheels, such as by an increased depth of the lid 130 on the bottom face. Above the jog in the line of closure 150, the line of closure is located largely near one of the major faces to allow for more continuous volume in one shell portion, resulting in improved packing.

Figure 2:
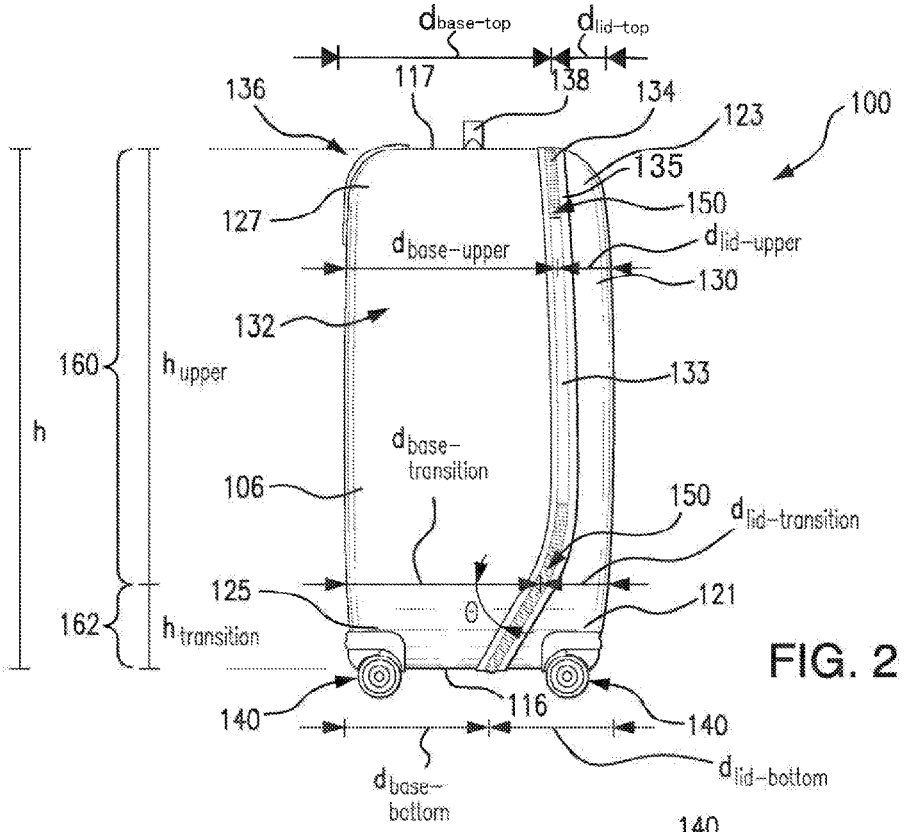
FIG. 2 is a left side view of the hard side luggage case of FIG. 1.
Figure 3:
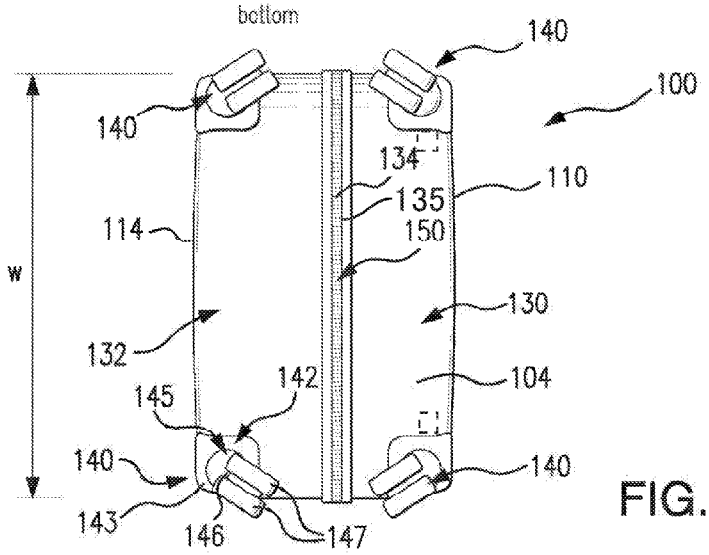
FIG. 3 is a bottom view of the hard side luggage case of FIG. 1.

With reference to FIG. 2, the enclosed volume 109 of the luggage case 100 may be divided along the height h of the luggage case 100 into at least an upper portion 160 with height $h_{upper}$ and a transition portion 162 with height $h_{transition}$. In some cases, the luggage case 100 may advantageously include a lower portion of the enclosed volume with height $h_{lower}$, (see, e.g., FIG. 7) but in other cases the luggage case 100 may not have a lower portion (or, alternatively, the lower portion may be considered to have no height and simply be the point at which the transition portion 162 terminates at the bottom face 104 of the luggage case 100).

At the top face 103 of the luggage case 100, the base 132 may have a depth $d_{base\text{-}top}$ (see, e.g., FIG. 2), and the lid 130 may have a depth $d_{lid\text{-}top}$ (see, e.g., FIG. 2). The ratio of $d_{base\text{-}top}$ to $d_{lid\text{-}top}$ may be, for example, approximately 95/5, 90/10, 85/15, 80/20, 75/25, or 70/30. In other words, the depth $d_{base\text{-}top}$ of the base 132 at the top face 103 of the luggage case 100 may be approximately 95, 90, 85, 80, 75, 70 (and so forth) percent of the total depth of the luggage case, while the depth $d_{lid\text{-}top}$ of the lid 130 at the top face 103 of the luggage case 100 may be approximately 5, 10, 15, 20, 25, 30 (and so forth) percent of the total depth of the luggage case 100, if the zipper track 134 is assumed to negligibly add to the total depth of the luggage case 100. Of course the zipper track 134 may add non-negligibly to the total depth of some luggage cases 100, but for convenience the discussion herein will assume that the zipper track 134 adds negligibly to the total depth of the luggage case 100. The ratio of $d_{base\text{-}top}$ to $d_{lid\text{-}top}$, in conjunction with the coupling of the spinner wheels 140 to the bottom face 104, provides for a lid 130 and base 132 with unevenly distributed enclosed volumes which allows for more convenient packing and closing of the luggage case 100 as compared with conventional hard side luggage cases.

Figure 4:
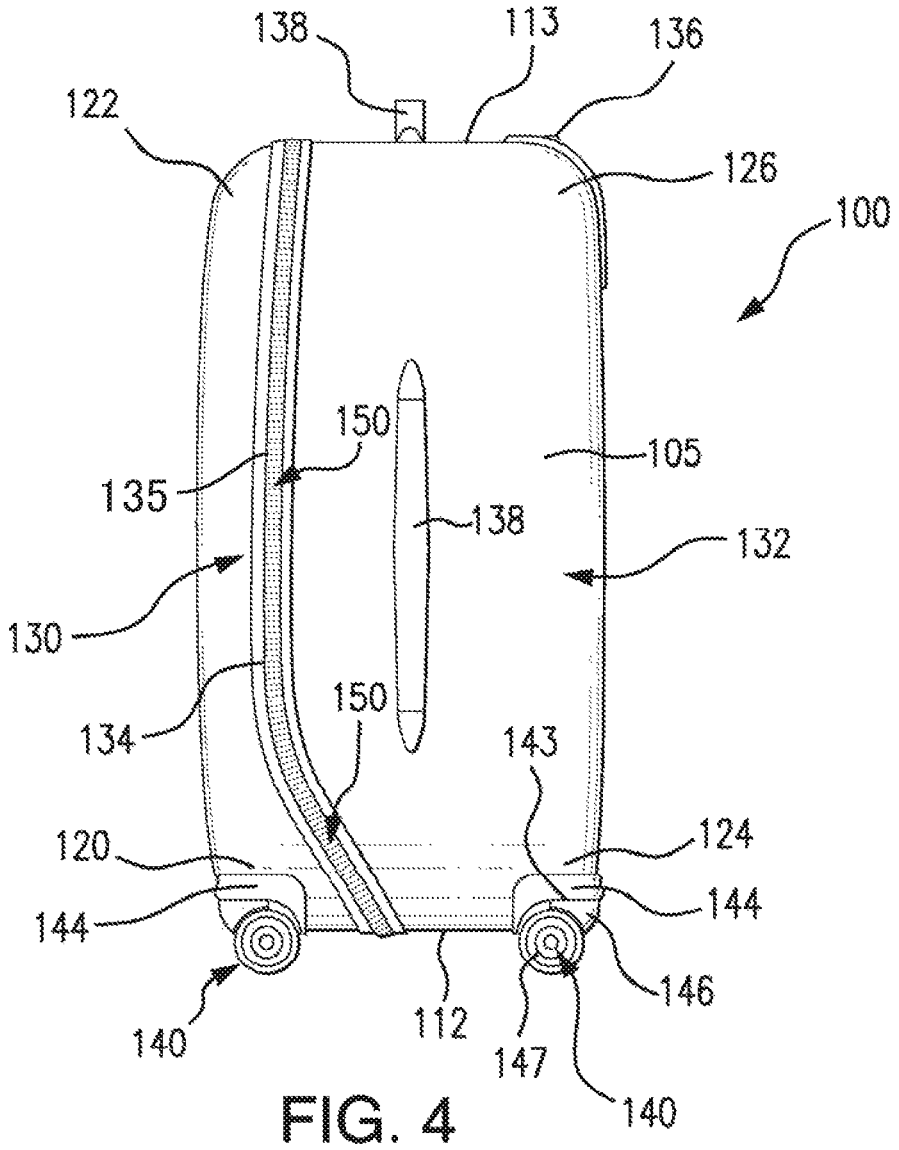
FIG. 4 is a right side view of the hard side luggage case of FIG. 1.

In the upper portion 160 of the luggage case 100, the base 132 may have a depth $d_{base\text{-}upper}$, and the lid 130 may have a depth $d_{lid\text{-}upper}$. The depth $d_{lid\text{-}upper}$ of the lid may be, for example, approximately 2 inches. With reference to FIGS. 2 and 4, the ratio of these respective depths may be substantially constant throughout the upper portion 160 of the luggage case. Alternatively, the ratio of these depths may vary slightly or greatly throughout the upper portion 160. In some luggage cases 100, the depths $d_{base\text{-}upper}$ and $d_{lid\text{-}upper}$ may be approximately the same as the depths $d_{base\text{-}top}$ and $d_{lid\text{-}top}$, respectively, along at least one segment of the upper portion 160. The height $h_{upper}$ of the upper portion 160 of the luggage case 100 may be approximately 60 to 95 percent of the total height h of the luggage case 100, and may be approximately 80 percent in one example.

In the transition portion 162 of the luggage case 100, the depth $d_{base\text{-}transition}$ of the base 132 may taper from the depth $d_{base\text{-}upper}$ of the base 132 in the upper portion 160 to the depth $d_{base\text{-}lower}$ of the base 132 in the lower portion of the luggage case 100 (not illustrated in FIGS. 1-5, but illustrated in FIG. 7) or to the depth $d_{base\text{-}bottom}$ of the base 132 at the bottom face 104 of the luggage case 100; the depth $d_{lid\text{-}transition}$ of the lid 130 may correspondingly taper from the depth $d_{lid\text{-}lower}$ of the lid 130 in the lower portion (not illustrated in FIGS. 1-5, but illustrated in FIG. 7) or the depth $d_{lid\text{-}bottom}$ of the lid 130 at the bottom face 104 of the luggage case to the depth $d_{lid\text{-}upper}$ of the lid 130 in the upper portion 160. The rate at which the depths of the base 132 and the lid 130 taper may depend on a tapering angle θ, which may be the angle between the tapering of the base 132 and/or lid 130, and the bottom face 104 and/or the top face 103 of the luggage case 100. Generally, larger tapering angles θ correspond to a slower tapering, whereas smaller tapering angles θ correspond to a faster tapering. The tapering angle θ may be, for example, at least 20 degrees and/or less than 80 degrees. In some examples, the tapering angle θ may be at least 65 degrees and less than 75 degrees. In two specific examples, the tapering angle θ may be 70 degrees or 72.77 degrees. The height $h_{transition}$ of the transition portion 162 of the luggage case 100 may be approximately 10 to 40 percent of the total height h of the luggage case, and may be approximately 20 percent in one example.

In the lower portion of the luggage case 100, if any, the depth $d_{base\text{-}lower}$ of the base 132 and the depth $d_{lid\text{-}lower}$ of the lid 130 may correspond with the depth of the base 132 and lid 130 at the lowest point of the transition portion 162, and may be substantially constant through the lower portion of the luggage case 100. Alternatively, the ratio of these depths may vary slightly or greatly throughout the lower portion. The height $h_{lower}$ of the lower portion of the luggage case 100 may be approximately 0 to 30 percent of the total height h of the luggage case 100, and may be approximately 0 percent in one example. In those examples with a lower portion, the line of closure 150 may intersect the bottom face 104 of the luggage case 100 perpendicularly to the bottom face 104, whereas in examples without a lower portion, the line of closure 150 may intersect the bottom face 104 of the luggage case 100 at an angle.

The depth $d_{base\text{-}bottom}$ of the base 132 at the bottom face 104 of the luggage case 100 may correspond with the depth $d_{base\text{-}lower}$ of the base 132 in the lower portion of the luggage case and/or at the lowest point of the transition portion 162, and the depth $d_{lid\text{-}bottom}$ of the lid 130 at the bottom face 104 of the luggage case 100 may correspond with the depth $d_{lid\text{-}lower}$ of the lid 130 in the lower portion and/or at the lowest point of the transition portion 162. The depth $d_{lid\text{-}bottom}$ of the lid 130 at the bottom face 104 may be, for example approximately 4 inches. The depths $d_{lid\text{-}bottom}$, $d_{base\text{-}bottom}$ of both the lid 130 and the base 132 at the bottom face 104 of the luggage case 100 may provide sufficient surface area to accommodate the base 143 of the housing 142 of the front spinner wheels 140 being coupled to the bottom face 104 of the luggage case 100 while providing a lid 130 that is relatively shallow along most of its height. This advantageously provides an arrangement whereby the relatively shallow lid 130 may easily be pivoted with respect to the base 132 during packing of the luggage case 100 thereby overcoming at least some of the problems associated with conventional hard-side luggage cases (e.g., heavy, inconvenient pivoting of a fully or partially packed lid). The ratio of $d_{base\text{-}bottom}$ to $d_{lid\text{-}bottom}$ may be, for example, approximately 50/50, or may be 45/55, 40/60, 55/45, 60/40, and so forth.

With continued reference to FIGS. 1 through 4, the respective depths of the lid 130 and the base 132 in the various portions 160, 162 along the height h of the luggage case 100, and the position of the line of closure 150, may determine the volume of the enclosed space 109 corresponding to the lid 130 and the volume of the enclosed space corresponding to the base 132. As described above, the uneven distribution of the enclosed spaces 109 between the lid 130 and the base 132 may facilitate relatively easy closing of the luggage case 100 during packing.

The total lid 130 volume may include the volume of the enclosed space 109 in the upper portion 160 of the lid 130, in the transition portion 162 of the lid 130, and in the lower portion of the lid 130 (if any), and the total base 132 volume may include the volume of the enclosed space 109 in the upper portion 160 of the base 132, in the transition portion 162 of the base 132, and in the lower portion of the base 132 (if any). In general, the base 132 volume may be increased (and the lid 130 volume may correspondingly be decreased) by increasing the depth of the base 132 in the upper portion 160 and decreasing the depth of the lid 130 in the upper portion 160. Similarly, the base 132 volume may be increased (and the lid 130 volume may correspondingly be decreased) by decreasing the height $h_{transition}$ of the transition portion 162, and/or by decreasing the tapering angle θ.

For example, the volume of the enclosed space 109 in the upper portion 160 of the lid 130 may be approximately the width w of the luggage case 100 multiplied by the depth $d_{lid\text{-}upper}$ of the lid 130 in the upper portion 160, and the volume of the enclosed space 109 in the upper portion 160 of the base 132 may be approximately the width w of the luggage case 100 multiplied by the depth $d_{base\text{-}upper}$ of the base 132 in the upper portion 160. If the depths of the lid 130 and the base 132 in the upper portion 160 of the luggage case 100 vary, the respective volumes of the enclosed space 109 in the lid 130 and the base 132 may be obtained by multiplying the width w of the luggage case 100 by the integral of the respective depths of the lid 130 and the base 132. Similarly, the volume of the enclosed space 109 in the transition portion 162 of the lid 130 and the base 132 may be obtained by multiplying the width w of the luggage case 100 by the integral of the respective depths of the lid 130 and the base 132 along the transition portion 162. Also, in those luggage cases 100 with a lower portion, the volume of the enclosed space 109 in the lower portion of the lid 130 and base 132 may be obtained by multiplying the width w of the luggage case 100 by the respective depths of the lid 130 and base 132 in the lower portion of the luggage case 100. Of course, if the front, rear, left, right, top, and/or bottom faces 101, 102, 106, 105, 103, 104 of the luggage case 100 are bowed, the volumes of the lid 130 and base 132 may depend on the amount of bowing of each of the one or more faces 101, 102, 106, 105, 103, 104, but for convenience, and clarity of description the volumes of the lid 130 and the base 132 described herein do not account for such bowing.

Figure 5:
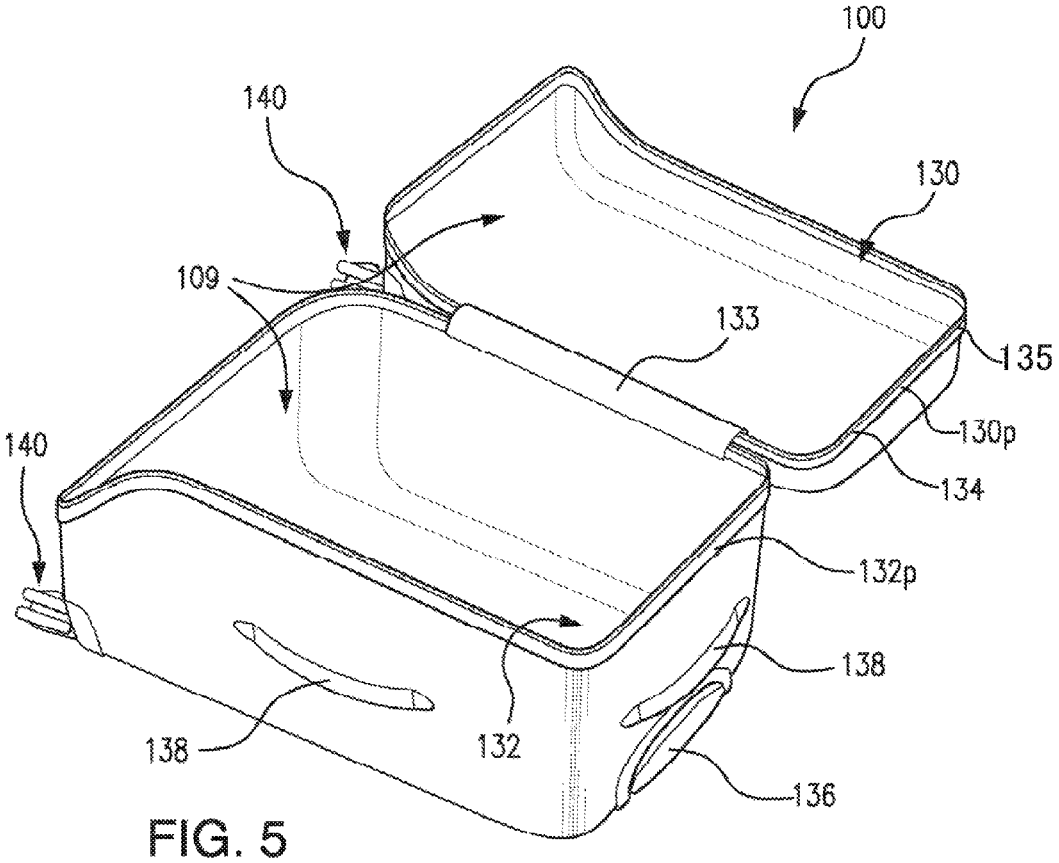
FIG. 5 is a perspective view of the hard side luggage case of FIG. 1 in an open configuration.

With reference to FIG. 5, in operation the luggage case 100 may be positioned on its base 132, the zipper 134 may be opened, and the lid 130 may be pivoted relative to the base 132 along the hinge 133. Articles, such as clothing, may be positioned within the base 132 of the luggage case 100, and in some cases articles may be positioned within the lid 130 of the luggage case 100, though the volume available for articles within the lid 130 of the luggage case 100 in some embodiments may be relatively small as compared with the volume available for articles within the base 132 of the luggage case 100. After securing any zippered fabric liners or other separators, the lid 130 of the luggage case 100 may again be pivoted along the hinge 133 in order to close the luggage case 100. Because the volume available within the lid 130 is relatively small in some embodiments, the weight of articles (if any) within the lid 130 may also be relatively small, and thus a user may advantageously pivot the lid 130 and close the luggage case 100 with relative ease.

With reference to FIGS. 1 through 5, in some examples, the line of closure or separation 150 may include a first portion and a second portion. The first portion of the line of closure 150 may extend along a first portion of opposing minor faces (such as the left and right faces 106, 105 of the luggage case 100) and one of opposing end walls (such as the top face 103 of the luggage case 100) positioned between the opposing minor faces. The first portion of the line of closure 150 may be proximate a major face (such as the front face 101 of the luggage case 100). The second portion of the line of closure 150 may extend along a second portion of the opposing minor faces in a direction away from the major face (such as the front face 101) and towards the other of the opposing major faces (such as the rear face 102). In some examples, when viewed from one of the opposing minor faces (such as the left or right face 106, 105 of FIGS. 2 and 4), the first portion and the second portion of the line or closure 150 may extend along different directions. In some examples, the first portion and the second portion of the line or closure 150 may extend along substantially the same or parallel direction (such as extending diagonally along the left and right faces 106, 105 or at any suitable angle relative to the top and bottom faces 103, 104). A support element, such as a spinner wheel 140 may be operably associated with one of the end walls (e.g., the bottom face 104), and the second portion of the line of separation 150 may extend around (or encompass) at least a portion of the support element such as a spinner wheel 140. The second portion of the line of separation 150 may extend around a spinner wheel 140, for example, in that the second portion of the line of separation 150 defines a structure to which the spinner wheel 140 may be coupled. In some examples, the second portion of the line of separation may extend around or encompass a spinner wheel 140 proximate the spinner wheel 140.

In some examples, the second portion of the line of separation 150 may extend across the second portion of the minor faces and may also extend across one of the opposing major faces (e.g., the front face 101). In another example, the second portion of the line of separation 150 may extend across the second portion of the minor faces and may also extend across one of the opposing end walls (e.g., the bottom face 104). In those embodiments in which the second portion of the line of separation 150 extends across, for example, the bottom face 104, the line of separation 150 may intersect the bottom face 104 at an angle to the bottom face, or may intersect the bottom face 104 perpendicularly to the bottom face 104.

Figure 6:
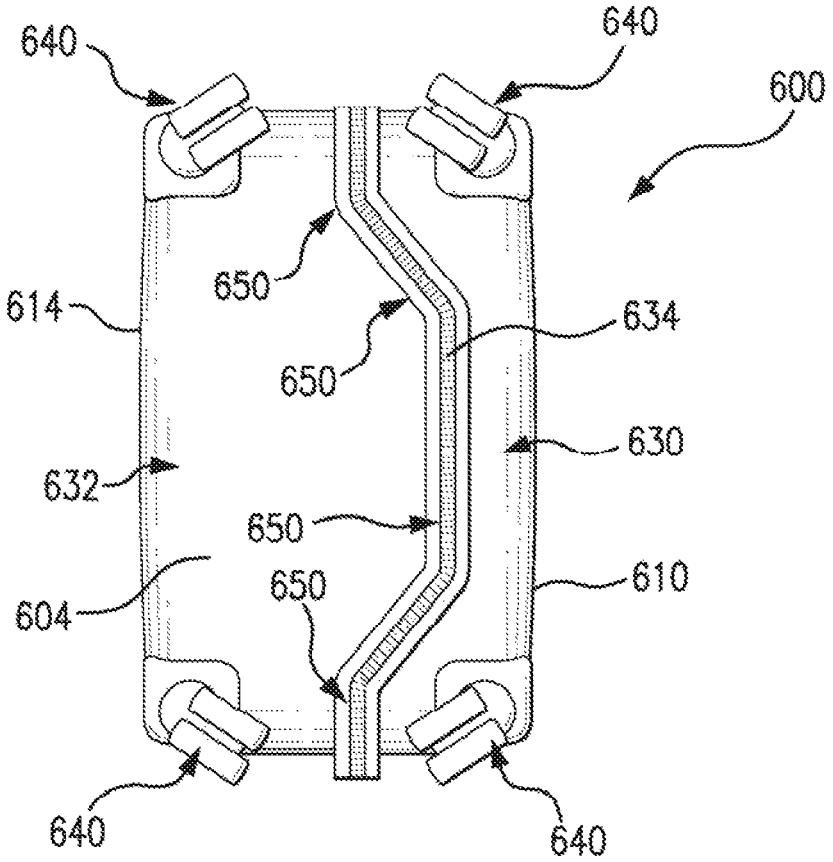
FIG. 6 is a bottom view of another hard side luggage case similar to that shown in FIG. 1 with a line of closure having a double curve on the bottom surface.

With reference to FIG. 6, a luggage case 600 may include a line of closure 650 (and associated zipper 634 or other closure device 634) that is advantageously double jogged around the front spinner wheels 640 to define the lid 630 and the base 632. As described above, the line of closure 650 on the left and right faces of the luggage case 600 may be jogged around the front spinner wheels 640. In some cases, the line of closure 650 on the bottom face 604 of the luggage case 600 may also or alternatively be jogged around the front spinner wheels 640.

Figure 7:
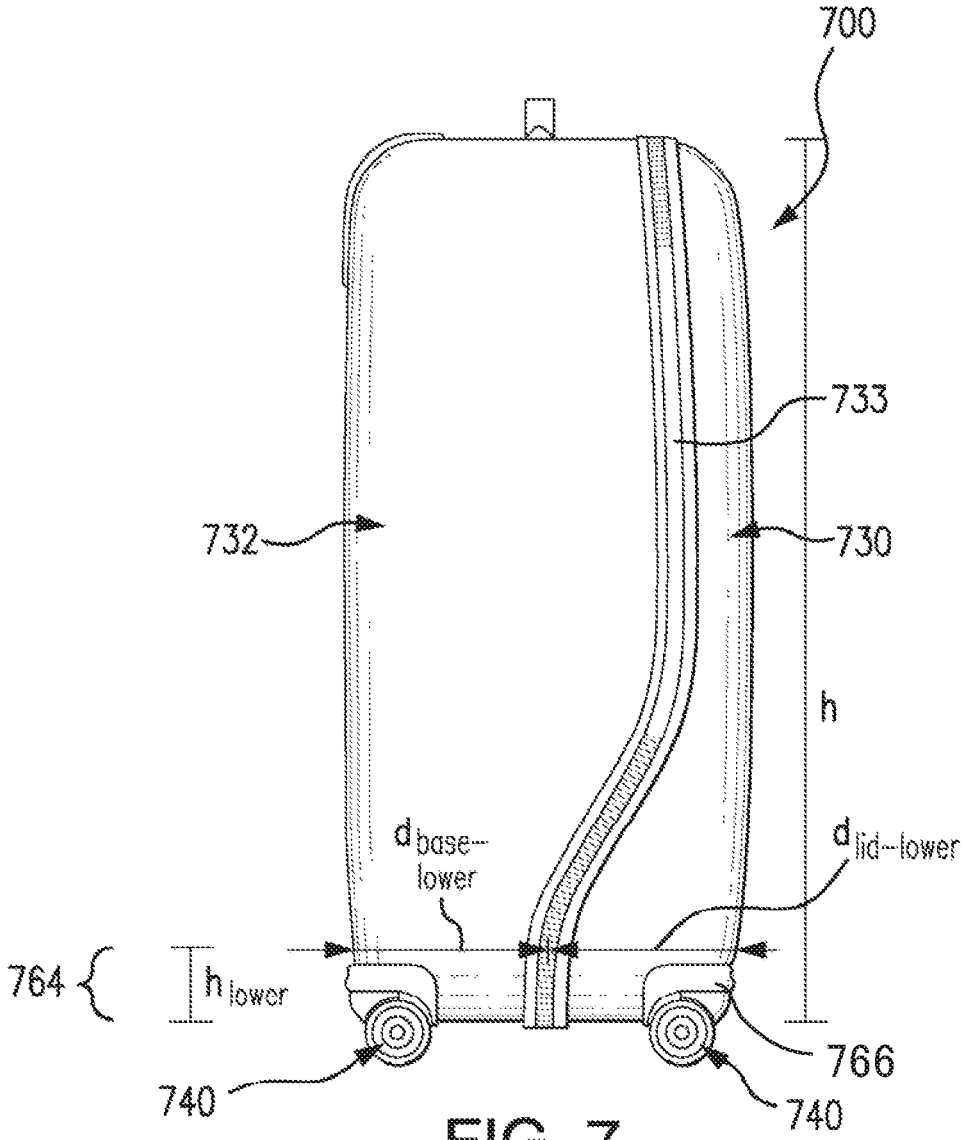
FIG. 7 is a left side view of another hard side luggage case similar to that shown in FIG. 1 with a line of closure having a double curve at a lower portion of the luggage case.

With reference to FIG. 7, a luggage case 700 may advantageously include a lower portion 764 with height $h_{lower}$ along the height h of the luggage case 700, and the base 732 may have a depth $d_{base\text{-}lower}$ in the lower portion 764 and the lid 730 may have a depth $d_{lid\text{-}lower}$ in the lower portion 764, as described above. In this example, the hinge 733 may not extend along the lower portion 764 of the luggage case 700. Also, in some examples, the height $h_{lower}$ of the lower portion 764 may be approximately the same as the height of the base portion 766 of the spinner wheels 740.

Figure 8:
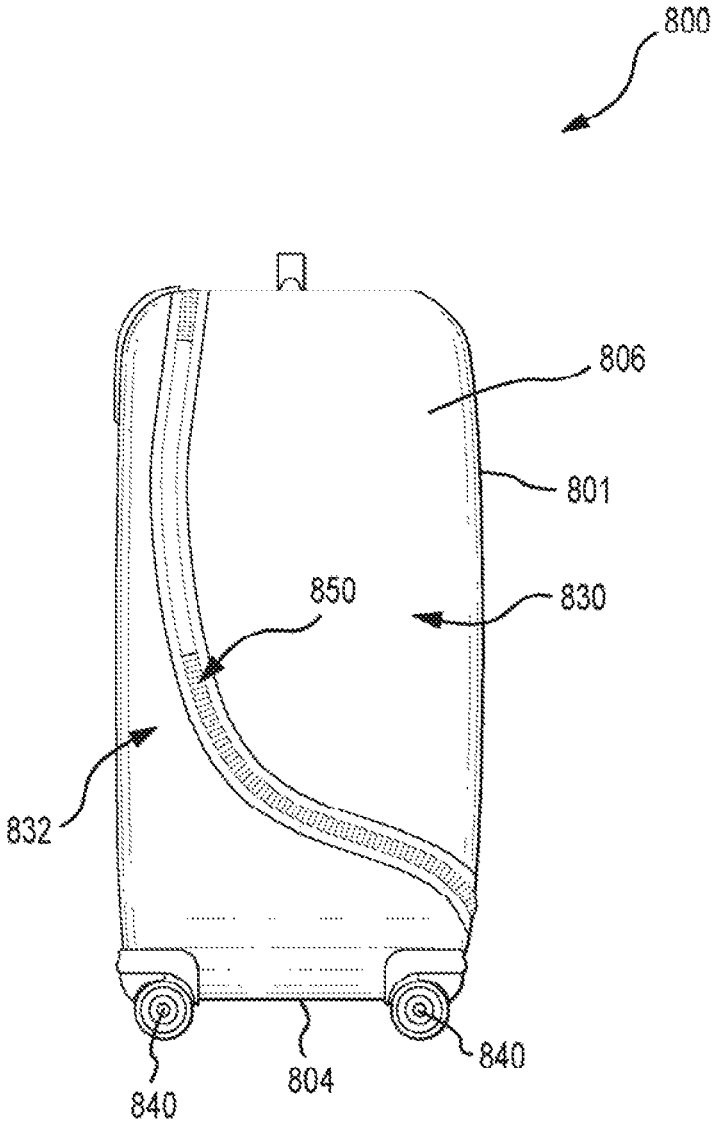
FIG. 8 is a left side view of another hard side luggage case similar to that shown in FIG. 1 with a line of closure extending from adjacent a rear major face to the front major face.

With reference to FIG. 8, the line of closure 850 for a luggage case 800 may extend across the left face 806 and right face, and also across the front face 801 of the luggage case (as opposed to across the bottom face 804 of the luggage case). In this manner, four spinner wheels 840 may be coupled to the base 832 and no spinner wheels may be coupled to the lid 830.

Figure 9:
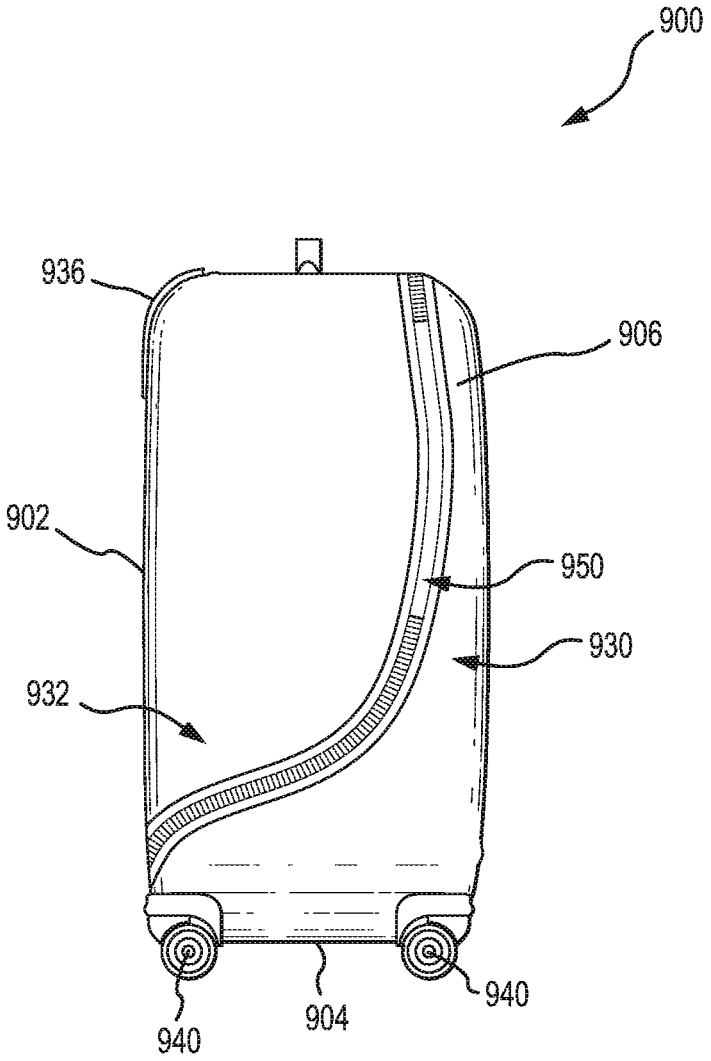
FIG. 9 is a left side view of another hard side luggage case similar to that shown in FIG. 1 with a line of closure extending from adjacent a front major face to the rear major face.

With reference to FIG. 9, in some examples, the telescoping handle 936 may be mounted only to a portion of the rear face 902 of the luggage case 900 without extending all the way to the bottom face 904. The line of closure 950 of the luggage case 900 may extend across the left face 906 and right face, and also across the rear face 902 (as opposed to across the front face 901 or the bottom face 904) along a portion of the rear face 902 between a bottom of the telescoping handle 936 and the spinner wheels 940. In this manner, four spinner wheels 940 may be coupled to the lid 930 and no spinner wheels may be coupled to the base 932.

The apparatuses and associated methods in accordance with the present disclosure have been described with reference to particular embodiments thereof in order to illustrate the principles of operation. The above description is thus by way of illustration and not by way of limitation. Various modifications and alterations to the described embodiments will be apparent to those skilled in the art in view of the teachings herein. Those skilled in the art may, for example, be able to devise numerous systems, arrangements and methods which, although not explicitly shown or described herein, embody the principles described and are thus within the spirit and scope of this disclosure. Accordingly, it is intended that all such alterations, variations, and modifications of the disclosed embodiments are within the scope of this disclosure as defined by the appended claims.

Where appropriate, common reference words are used for common structural and method features. However, unique reference words are sometimes used for similar or the same structural or method elements for descriptive purposes. As such, the use of common or different reference words for similar or the same structural or method elements is not intended to imply a similarity or difference beyond that described herein.

In methodologies directly or indirectly set forth herein, various steps and operations are described in one possible order of operation, but those skilled in the art will recognize that the steps and operations may be rearranged, replaced, or eliminated without necessarily departing from the spirit and scope of the disclosed embodiments.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

The invention claimed is:

1. A luggage case, comprising:

opposing sidewalls forming a first minor face and a second minor face, opposing sidewalls forming major faces, and opposing end walls together forming an article defining an enclosed space; and a line of separation formed in said minor faces and end walls along which said article separates;

wherein:

the enclosed space is divided into a first interior volume and a second interior volume by the line of separation;

the line of separation defines a first upper depth of the first minor face, a second upper depth of the first minor face, a first lower depth of the first minor face, and a second lower depth of the first minor face;

the first upper depth is greater than the second upper depth, and the second upper depth is greater than the second lower depth; and the first interior volume is greater than the second interior volume.

2. The luggage case of claim 1, wherein the first volume is from about 51% to about 95% of the total volume of the luggage case.

3. The luggage case of claim 2, wherein the first volume is from about 64% to about 92% of the total volume of the luggage case.

4. The luggage case of claim 1, wherein the first upper depth and second upper depth are associated with a first portion of line of separation and the first lower depth and second lower depth are associated with a second portion of the line of separation and the two portions extend in two different directions.

5. The luggage case of claim 4, wherein the first portion of the line of separation extends along a first portion of each minor face at a location proximate one of said major faces and along corresponding one of said opposing end walls positioned therebetween.

6. The luggage case of claim 4, wherein the second portion of the line of separation extends along a second portion of each minor face in a direction away from one of said major faces and towards the other of said major faces.

7. The luggage case of claim 4, wherein the two portions meet at a transition portion positioned at a location between 10% and 40% of a height dimension of the luggage case as measured from an end wall.

8. The luggage case of claim 7, wherein the transition portion is located at about 10% to about 20% of the height dimension of the luggage case and the first volume is from about 52% to about 95% of the total volume of the luggage case.

9. The luggage case of claim 7, wherein the transition portion is located at about 20% to about 40% of the height dimension of the luggage case and the first volume is from about 51% to about 94% of the total volume of the luggage case.

10. The luggage case of claim 7, wherein the transition portion forms a discrete angle or a curve defining a taper angle.

11. The luggage case of claim 10, wherein the taper angle is from 20 degrees to 80 degrees.

12. The luggage case of claim 7, wherein the first volume is increased and the second volume is decreased by decreasing the height of the transition portion.

13. A luggage case, comprising:

a lid operatively coupled to a base, the lid and the base defining a line of closure along abutting edges of respective perimeters of the lid and the base;

wherein:

the line of closure defines a lid volume having a first depth along a first portion of said case and a second depth along a second portion of said case, the line of closure further defining a base volume having a third depth along a first portion of said case and a fourth depth along a second portion of said case;

the first depth and the second depth are different; and the lid volume is less than the base volume.

14. The luggage case of claim 13, wherein the first depth is less than the second depth.

15. The luggage case of claim 13, wherein the second depth is up to 12 times greater than the first depth.

16. The luggage case of claim 15, wherein the second depth is from about 2 times to about 8 times greater than the first depth.

17. The luggage case of claim 13, wherein the lid volume is from about 5% to about 49% of the total volume of the luggage case.

18. The luggage case of claim 13, further comprising a plurality of support elements.

19. The luggage case of claim 18, wherein the support elements are wheels and at least one wheel is coupled to the lid at the second portion of the case and at least one wheel is coupled to the base at the second portion of the case.

20. The luggage case of claim 13, wherein a closure device is positioned along at least a portion of the line of closure.

* * * * *